US006657519B2

(12) United States Patent
Guguen et al.

(10) Patent No.: US 6,657,519 B2
(45) Date of Patent: Dec. 2, 2003

(54) WAVEGUIDE FILTER

(75) Inventors: Charline Guguen, Rennes (FR); Gérard Haquet, Chateaubourg (FR); Corinne Nicolas, La Chapelle des Fougeretz (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/971,725

(22) Filed: Oct. 4, 2001

(65) Prior Publication Data

US 2002/0044032 A1 Apr. 18, 2002

(30) Foreign Application Priority Data

Oct. 18, 2000 (FR) ..... 00 13582

(51) Int. Cl.[7] ..... H01P 1/208
(52) U.S. Cl. ..... 333/208; 333/212
(58) Field of Search ..... 333/208, 212; 29/600

(56) References Cited

U.S. PATENT DOCUMENTS

| | | | | | |
|---|---|---|---|---|---|
| 3,137,828 | A | * | 6/1964 | Gerig et al. | 333/212 |
| 4,701,728 | A | * | 10/1987 | Igarashi | 333/212 |
| 4,724,408 | A | | 2/1988 | Igarashi | 333/212 |
| 5,867,077 | A | * | 2/1999 | Lundquist | 333/208 |

FOREIGN PATENT DOCUMENTS

| | | | | |
|---|---|---|---|---|
| DE | 3617203 A1 | * | 11/1987 | |
| DE | 3512936 | | 10/1996 | H01P/1/208 |
| GB | 731498 | | 6/1955 | |
| JP | 63187801 A | * | 8/1988 | |

* cited by examiner

*Primary Examiner*—Seungsook Ham
(74) *Attorney, Agent, or Firm*—Joseph S. Tripoli; Kuniyuki Akiyama

(57) ABSTRACT

Waveguide filters for filters operating at millimeter wavelengths which require high accuracy. The filter includes a plurality of discs held in the cylinder of a support. Each disc has a recess defining cavity size. The various parts forming the filter are simplified thereby making it possible to reduce production costs while providing good accuracy.

7 Claims, 1 Drawing Sheet

WAVEGUIDE FILTER

BACKGROUND OF THE INVENTION

1. Field of the Invention

The invention relates to a waveguide filter for circuits operating at microwave frequencies.

2. Description of the Related Art

Within the context of broad bandwidth wireless networks, it is known to use increasingly high frequencies so to allow the transmission of high bit-rate applications such as video. The purpose of these networks is also to allow data exchange between at least one base station (access providers) and a plurality of user stations, networks commonly called point-multipoint networks. At present, the standard MPT-1560-RA provides for the use of frequencies located between 40.5 and 42.5 GHz.

In order to carry out bidirectional communications of the full-duplex type, it is known to allocate frequencies which are different for transmission and reception. However, it is necessary to have recourse to high-performance filtering devices in order to separate the transmission and reception signals, since the transmission signal interferes with the reception signal. In order to meet the filtering restrictions (microwave, broad bandwidth, high rejection outside the bandwidth), it is known to have recourse to filters with cavities coupled by discontinuities, commonly called waveguide filters.

Waveguide filters act on the received electromagnetic wave before the latter is transformed into an electrical signal. The filtering function is provided by the shape of the structure. The size of the filter is proportional to the wavelength, the length of the cavities being equal to half of the wavelength.

One technique for fabricating a waveguide filter consists in producing two shells, each equivalent to half of the filter cut along a plane passing through its central axis, then in reassembling the two shells. In order to work with millimeter waves, it is necessary to have good accuracy, to less than 50 $\mu$m on the finished filter. The production of a filter in two shells with such accuracy involves a production cost which is too high for it to be integrated into a mass-produced product. There are other techniques, in particular using tuning screws to compensate for tolerance drift, the fabrication costs of which are also high.

In addition, documents GB-A-0 731 498 and DE-A-35 12 936 disclose waveguide filter devices as shown in FIG. 1. The filter consists of a plurality of discs 2 and 3 held in a support 1. A first type of disc 3 defines the sizes of the filter cavities, and a second type of disc 2 defines the cavity separations. Such a filter is difficult to isolate electrically when the number of discs is high.

SUMMARY OF THE INVENTION

The invention proposes a waveguide filter with a low-cost structure. The filter of the invention consists of a plurality of discs held in a cylinder with a square, rectangular or circular base. In the present document, the term cylinder must be understood by the person skilled in the art as the mathematical definition, namely a volume generated, on the one hand, by a straight line which is displaced parallel to a fixed direction while standing on a fixed planar curve and, on the other hand, two parallel planes cutting the generating straight lines, the projection of the planar curve on one of the planes in the fixed direction corresponding to the base of the cylinder. Each disc defines an iris and a cavity, which reduces the number of electrical contacts. The various parts constituting the filter are simple and therefore cheap, while providing good conductivity due to a smaller number of contacts than in the prior art.

Thus, the invention is a waveguide filter which comprises a support comprising a cavity, the cavity being a cylinder of any base, and a plurality of discs the external shape of which corresponds to the base of the cylinder, each disc comprising at least one recess whose depth corresponds to the length of a cavity, the end of the recess being furnished with at least one coupling aperture. The filter thus produced has the other advantage of not requiring any tuning during assembly.

BRIEF DESCRIPTION OF THE DRAWINGS

The invention will be better understood, and other particular features and advantages will become clear on reading the description which follows, the description referring to the appended drawings among which.

DESCRIPTION OF THE PREFERRED EMBODIMENTS

Figure 1:
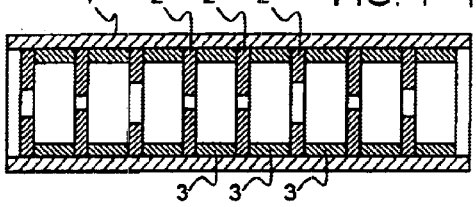
FIG. 1 PRIOR ART
FIG. 1 shows a first embodiment of a waveguide filter according to the prior art.
Figure 2:
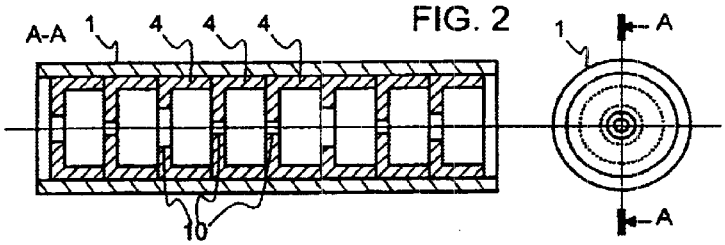
FIG. 2 shows a second embodiment of a waveguide filter according to the invention.
Figure 3:
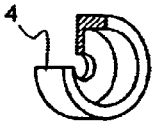
FIG. 3 shows a disc in partial section as used in the filter of FIG. 2, FIGS. 4*a* to 4*d* show various possibilities for ends of the support which are used for the filter of FIG. 2, FIGS. 5*a* to 5*d* show variants of discs for a square-based cylinder.

FIG. 2 shows a first preferred embodiment of the waveguide filter in side view and in end-on view along the section A—A. The filter comprises a support 1 through which a cavity passes. The cavity is a cylinder with a circular base in the example of FIG. 2. A plurality of discs 4, the external shape of which corresponds to the base of the cylinder, are placed inside the support 1. FIG. 3 shows a disc 4 in partial section. The discs 4 comprise a recess, the depth of which corresponds to the length of a cavity of the filter. The profile of the recess corresponds to the profile of the waveguide. The discs have a simple shape which makes it possible to have relatively low machining costs in spite of the accuracy required. An aperture 10 is made at the end of the recess so as to produce the coupling between the cavities of the filter. The discs 4 are either made of a conducting material, or made of a non-conducting material coated with a conducting layer. Preferably, the discs 4 are made in a metal or a metal alloy with low sensitivity to temperature variations.

In order to determine the size of the various discs 4, a waveguide filter calculation of the conventional type is carried out and the various dimensions are transferred to the various discs. To calculate the dimension of the filter, the person skilled in the art can refer to the book entitled "Microwave filters, impedance-matching networks, and coupling structures" by George L. Matthaei, Leo Young and E. M. T. Jones, published by Artech House Books in 1980.

The filter is electrically isolated by contact between the various discs, which requires a good surface condition, for example of average roughness $R_a$=0.8 $\mu$m. The fact of using fewer discs than in the prior art decreases the number of electrical contacts and therefore improves the electrical isolation. To improve the electrical isolation, it is preferable that the support 1 is also a conductor.

Figure 4A:
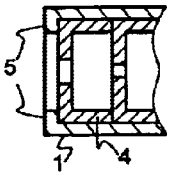
Figure 4B:
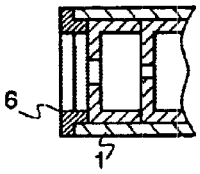
Figure 4C:
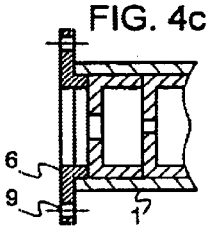
Figure 4D:
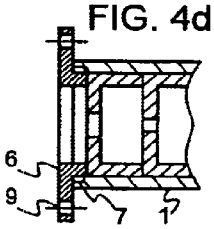

To hold the discs 4 in the support 1, the support 1 should be fitted with blocking means. FIGS. 4*a* to 4*d* show various means implemented. The first blocking means 5 shown in FIG. 4*a* consists of a skirt 5 which acts as a stop to the discs 4. The skirt 5 can only be used on a single end of the support 1. A second means may consist of a plug 6 as shown in FIGS. 4*b*, 4*c* and 4*d*. The plug may be adhesively bonded (FIGS. 4*b* and 4*c*) or screwed (FIG. 4*d*) on the support 1 if a screw thread 7 is made on the said support 1. The plug 6 may also be fitted with attachment means 9, for example holes, which make it possible to attach the filter to another device such as another waveguide circuit or an antenna horn.

The embodiments described above relate to a waveguide filter using a circular-based cylinder. The circular base makes it possible to have a very low machining cost, the parts being made mainly by turning.

The circular-based cylinders do not allow all the types of waveguide filter to be made. On the contrary, other filter structures with a holding cylinder which comprise discs to define the cavities of the filter are quite envisageable. The holding cylinder may have a square or rectangular base, the support cavity then being machined by broaching.

Figure 5A:
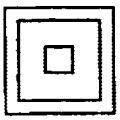
Figure 5B:
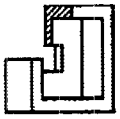
Figure 5C:
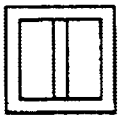
Figure 5D:
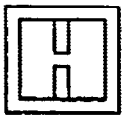
Figure 6A:
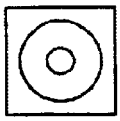
FIGS. 6*a* to 6*d* show variants of discs for square-based cylinders with a circular waveguide.
Figure 6B:
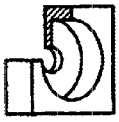
Figure 6C:
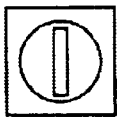
Figure 6D:
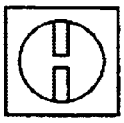

FIGS. 5*a*, 5*b*, 5*c* and 5*d* illustrate discs with a square base. FIGS. 5*a* and 5*b* illustrate a disc with a square base which comprises a recess of square section with a square aperture. Such a disc is made, for example, by pressing and punching. FIGS. 5*c* and 5*d* illustrate discs of a polarized filter, the transfer characteristics of which vary according to the polarization of the waves passing through the said filter. The disc of FIG. 5*c* comprises a rectangular aperture made by punching in order to favour a particular polarity in transmission. The disc of FIG. 5*d* comprises an aperture over virtually the whole section of the waveguide except for two small tongues carrying out filtering on a particular polarity, the aperture also being made by punching. Although more complex to produce than filters using circular-based cylinders, the square based filters acting on the polarity of the wave are much less expensive than the filters made according to the prior art. Of course, the person skilled in the art can adapt the shape of the apertures made in the discs to the types of filtering desired. To obtain various aperture shapes, the person skilled in the art can refer to the literature which relates to waveguide filter calculation.

If the person skilled in the art prefers to keep a circular waveguide while at the same time producing filtering which varies according to the polarity of the wave, several possibilities of adaptation can be envisaged. A first possibility consists in producing a groove in a circular-based cylinder and a groove in the periphery of each disc. During assembly, a key is added in order to hold the angular position of the discs in the cylinder.

Another solution consists in using a square-based cylinder with square-based discs, the recess of which is circular, the recess then being made by milling and the apertures by punching. FIGS. 6*a*, 6*b*, 6*c* and 6*d* illustrate square-based discs with a circular waveguide, said discs producing functions similar to the discs of FIGS. 5*a*, 5*b*, 5*c* and 5*d*.

What is claimed is:

1. Waveguide filter which comprises:

a support which comprises a cavity, the cavity being a cylinder with a base, a plurality of solid cylindrical discs the external shape of which corresponds to the base of the cylinder, each disc comprising at least one recess whose depth corresponds to the length of a cavity formed in a solid sidewall, the end of the recess being furnished with at least one coupling aperture.

2. Filter according to claim 1, characterized in that the base of the cylinder is a circle.

3. Filter according to claim 2, characterized in that the support comprises, at least one end, a screw thread in order to receive an attachment cover.

4. Filter according to claim 1, characterized in that the base of the cylinder is a rectangle.

5. Filter according to claim 1, characterized in that the support (1) is made of a conducting material.

6. Filter according to claim 1, characterized in that the discs are made in metal or a metal alloy.

7. Filter according to claim 4, characterized in that the base of the cylinder is a square.

* * * * *